US006346188B1

(12) United States Patent
Shuster et al.

(10) Patent No.: US 6,346,188 B1
(45) Date of Patent: Feb. 12, 2002

(54) BATTERY-POWERED CATHODIC PROTECTION SYSTEM

(75) Inventors: Nicholas Shuster, Madison, OH (US); Gregory J. Gabert, Madeira Beach, FL (US)

(73) Assignee: Enser Corporation, Pinellas Park, FL (US)

( * ) Notice: Subject to any disclaimer, the term of this patent is extended or adjusted under 35 U.S.C. 154(b) by 0 days.

(21) Appl. No.: 09/535,626

(22) Filed: Mar. 24, 2000

(51) Int. Cl.[7] ..... C23F 13/00

(52) U.S. Cl. ..... 205/734; 205/740; 204/196.01; 204/196.1; 204/196.19; 204/196.21; 204/196.25; 204/196.27; 204/196.36; 204/196.37

(58) Field of Search ..... 205/734, 740; 204/196.36, 196.37, 196.27, 196.21, 196.19, 196.1, 196.01, 196.25

(56) References Cited

U.S. PATENT DOCUMENTS 5,141,607 A * 8/1992 Swiat ..... 205/734

5,609,748 A * 3/1997 Kotowski et al. ..... 205/734

* cited by examiner

*Primary Examiner*—Bruce F. Bell
(74) *Attorney, Agent, or Firm*—Thomas, Kayden, Horstemeyer & Risley, LLP

(57) ABSTRACT

The present disclosure relates to a cathodic protection system for inhibiting oxidation of a reinforcing member disposed within a cementitious structure. The system comprises a compact, autonomous battery adapted to mount to the cementitious structure at an open-air location, the battery having a positive terminal and a negative terminal, a conductor adapted to electrically connect the negative terminal of the battery to the reinforcing member of the cementitious structure, an anode jacket constructed of a cementitious material and being adapted to be placed in physical contact with the cementitious structure, and an anode disposed within the anode jacket and being adapted to be positioned proximate to a portion of the reinforcing member disposed within the cementitious structure that is to be cathodically protected, the anode being electrically connected to the positive terminal of the battery.

73 Claims, 4 Drawing Sheets

BATTERY-POWERED CATHODIC PROTECTION SYSTEM

FIELD OF THE INVENTION

The present disclosure relates to a cathodic protection system. More particularly, the present disclosure relates to a method and apparatus for providing power to impressed current cathodic protection systems at relatively low voltage to inhibit chloride-induced corrosion of the reinforcing steel embedded in concrete structures.

BACKGROUND OF THE INVENTION

Chloride-induced corrosion occurs in salt water and brackish water areas, causing substantial structural damage to steel-reinforced bridge pilings, marine substructures, concrete balconies, and other steel reinforced concrete structures. In northern climates where road de-icing salts are employed, similar reinforcing steel corrosion is observed. Corrosion of the reinforcing steel, which is embedded into concrete structures to impart strength to the concrete, is a well-known problem in the art. The concrete comprising many bridge pilings, substructures, piers, wharves and the like is generally porous and permits the ingress of salt water. In tropical and subtropical environments, warm temperatures accelerate the diffusion rate of the chloride (which comprises salt) toward the steel reinforcing members. Warm temperatures can also cause a partial drying-out of the structures resulting in evaporative drying which increases the concentration of the chloride within the steel-reinforced concrete structure. Also, warm temperatures accelerate the diffusion of atmospheric oxygen into the porous concrete. When the chloride concentration reaches approximately 0.6 to 0.8 kg per cubic meter, sufficient chloride is present to initiate the corrosion process, specifically, corrosion of the iron contained within the steel reinforcing bars.

The familiar iron oxide (commonly known as rust) compounds which form as a result of the reaction of iron with atmospheric oxygen in the presence of water, occupy considerably more volume than the parent iron contained in the steel. Due to the limited amount of space available for volume increases, as little as 0.002 in. (2 mils) of corrosion on the surfaces of the reinforcing members is sufficient to induce tremendous tensile stresses on the neighboring concrete. When the exerted stress exceeds the tensile strength of the concrete, severe cracking and/or spalling of the concrete can occur. Eventually, the mechanical integrity of the structure becomes sufficiently compromised that costly repair or complete replacement is necessary.

Several techniques are currently in use to inhibit or completely halt the deleterious corrosion process described above. As the corrosion process is oxidative in nature, rendering the steel cathodic (i.e., placing the steel in a reducing state) effectively prohibits the oxidation process from occurring. This is accomplished by supplying electrons to the steel reinforcing members so that oxidation of the steel does not occur. Instead, the oxygen at the surface of the steel is electrochemically reduced. In other words, if electrons are provided to replace those that would normally be lost during the corrosion reaction (in that iron loses electrons when it oxidizes), the iron will not oxidize.

One known technique used to protect reinforcement steel is to place it in electrical contact with a sacrificial material such as zinc or aluminum. For instance, a zinc anode can be used to protect the steel from oxidizing. In such an arrangement, as the iron in the reinforcing steel attempts to rust, the zinc anode preferentially sacrifices its electrons to the iron. In this process, the zinc sacrifices itself and corrodes instead of the steel. This technique, known as galvanic protection, while relatively simple, suffers from several drawbacks. First, because the zinc is sacrificial it is eventually consumed. Where the zinc anode is disposed in a jacket of concrete as in pile applications, this corrosion of the zinc will result in zinc corrosion products building up adjacent to the zinc base metal surface. Such reaction products can increase the electrical impedance on the pile jacket, thereby affecting the amount of protecting current that can be supplied to the steel. If the resistance of the zinc pile jacket increases over time, and if sufficient current (i.e., electron flow) cannot be provided to the steel, the steel will then rust. Due to this phenomenon, pile jacket replacement or costly repair may eventually be required since zinc exhaustion eventually occurs.

A second technique has been developed which affords corrosion protection for the life of the structure to which it is applied. In this technique, a dimensionally stable titanium anode coated with a catalytic coating is used which promotes electrochemical activity. As in the method described above, the anode can be, for example, disposed in a pile jacket about a bridge pile to be protected. However, since titanium-based dimensionally stable anodes are not capable of providing a source of electrons (i.e., they do not induce a current flow to the steel reinforcing members), an external power supply must be provided to supply an impressed current between the anode and the reinforcing steel (cathode). Normally, this current is supplied by connecting the negative terminal of the power supply (i.e., electron source) to the reinforcing steel, and the positive terminal of the power supply to the catalyzed titanium anode. In the pile application, the electrical circuit is completed with the salt water which penetrates the concrete existing between the anode and the reinforcing steel to be protected. Once configured in this manner, energizing the power supply results in current flow to the reinforcing steel. In previous impressed current systems, controllable direct current (DC) power supplies that take commercially available alternating current (AC) line power and rectify it into DC power have been used. This rectification of the AC power is accomplished through use of one or more rectifiers.

Although conventional impressed current techniques present advantages over galvanic methods, these techniques also present several important drawbacks. First, AC power typically must be available at the site. In many rural or remote locations, power is not available and the cost of running power lines to the site can be considerable. Since one, or at most only a few, power supplies is usually used, extensive wiring conduits normally must be installed between the power supply and the individual pilings, substructures, or road deck areas to be protected. Depending on the particulars of the application, wiring and conduit installation can be extremely expensive. Therefore, externally powered cathodic protection systems are not cost-effective on structures where only a part of the structure requires immediate protection. In addition, power supply vandalism and damage due to lightning strikes often requires greater-than-desirable maintenance. Furthermore, in order to be economically viable, AC to DC power supplies must have sufficient voltage to power a large structure. Such voltage is needed to overcome the resistance of the wiring running between the power supply and the structure. In the event of a malfunction or drift in the control section of the power supply, an abnormally high voltage output can give rise to excessive voltage at the surface of the reinforcing steel. The resulting impressed current therefore can be greater than that needed to electrochemically reduce the available oxygen and prevent corrosion. Under these conditions, the steel can be forced to negative potentials that are sufficient to support water electrolysis with concomitant nascent hydrogen evolution. Nascent hydrogen, generated at the surface of the steel, represents a potentially serious hazard in that hydrogen embrittlement of the steel reinforcing members can occur.

To address these limitations, large zinc-air batteries have been used on bridges to protect groups of four to six pilings (commonly referred to as a bent). Although solving several of the problems associated with the aforementioned AC/DC systems, the batteries proved to be too large to be practical for powering only a single piling, and too cumbersome to install above the water line. Powering multiple bridge pilings in this manner requires pile-to-pile wiring conduit, further restricting economic viability. In addition, because of their large size, these batteries typically must be mounted below the water line. This below-the-water-line mounting is difficult and expensive mounting bracket arrangements typically are required to attach the battery to its associated bent. Moreover, each of the batteries used in such systems typically comprises a large volume of concentrated liquid potassium hydroxide electrolyte (up to 10 gallons or more), which is hazardous to installation personnel as well as the surrounding environment. The large volume of liquid electrolyte also complicates subsequent battery disposal. Further still, since alkaline-air batteries require oxygen from the air in order to function, batteries mounted below the water line require a breather tube or snorkel which extends out of the water. Irregular heating of these tubes by direct sunlight exposure can result in "thermal plugging", wherein oxygen is unable to diffuse into the battery at a rate fast enough to support the desired output current from the battery.

In another effort to avoid the drawbacks associated with AC/DC systems, solar energy based systems have been used in which solar cells are provided to generate power from ambient light. Unfortunately, due to the intricate components required by such systems, these systems can be cost prohibitive. In addition, these systems are sensitive and therefore extremely vulnerable to vandalism which can require replacement of expensive components.

From the foregoing, it can be appreciated that it would be desirable to have a cathodic protection system which avoids the aforementioned technical and economic limitations encountered with conventional systems. In particular, advantageous would be a discrete, autonomous battery-based system that requires no maintenance, is self-regulating, has a long operating life, is both simple and economically effective to install, is safe to the environment and installation/maintenance personnel, and is easy to dispose of following its useful life.

SUMMARY OF THE INVENTION

The present disclosure relates to a cathodic protection system for inhibiting oxidation of a reinforcing member disposed within a cementitious structure. The system comprises a compact, autonomous battery adapted to mount to the cementitious structure at an open-air location, the battery having a positive terminal and a negative terminal, a conductor adapted to electrically connect the negative terminal of the battery to the reinforcing member of the cementitious structure, an anode jacket constructed of a cementitious material and being adapted to be placed in physical contact with the cementitious structure, and an anode disposed within the anode jacket and being adapted to be positioned proximate to a portion of the reinforcing member disposed within the cementitious structure that is to be cathodically protected, the anode being electrically connected to the positive terminal of the battery.

In a preferred arrangement, the system is adapted for use with a plurality of piles, for example a plurality of bridge pilings, and one or more autonomous batteries are used to power each pile on a separate, individual basis. In such a configuration, long-lasting, maintenance-free protection can be provided to each pile with a plurality of simple, inexpensive cathodic protection systems.

The present disclosure further relates to a method for cathodically protecting a reinforcing member disposed within a concrete structure. The method comprises the steps of placing an anode adjacent the reinforcing member to be protected within a cementitious material contiguous with the concrete structure in which the reinforcing member is disposed, electrically connecting the anode to a compact, autonomous battery that can be mounted to the concrete structure in an open-air environment, and electrically connecting the battery only to one particular reinforcing member of one concrete structure.

In a preferred method, a plurality of piles, for example bridge piles, can be cathodically protected by forming a jacket around each of the piles at an anticipated water line, disposing an anode within each jacket, each anode substantially surrounding each bridge pile adjacent the water line, mounting a compact, autonomous battery to each bridge pile at a point well above the water line, electrically connecting each battery to the respective anode disposed about its bridge pile, and electrically connecting each battery to the respective reinforcing member of its bridge pile. With such a method, each bridge pile is provided with its own autonomous cathodic protection system.

The features and advantages of the invention will become apparent upon reading the following specification, when taken in conjunction with the accompanying drawings.

DETAILED DESCRIPTION

Figure 1:
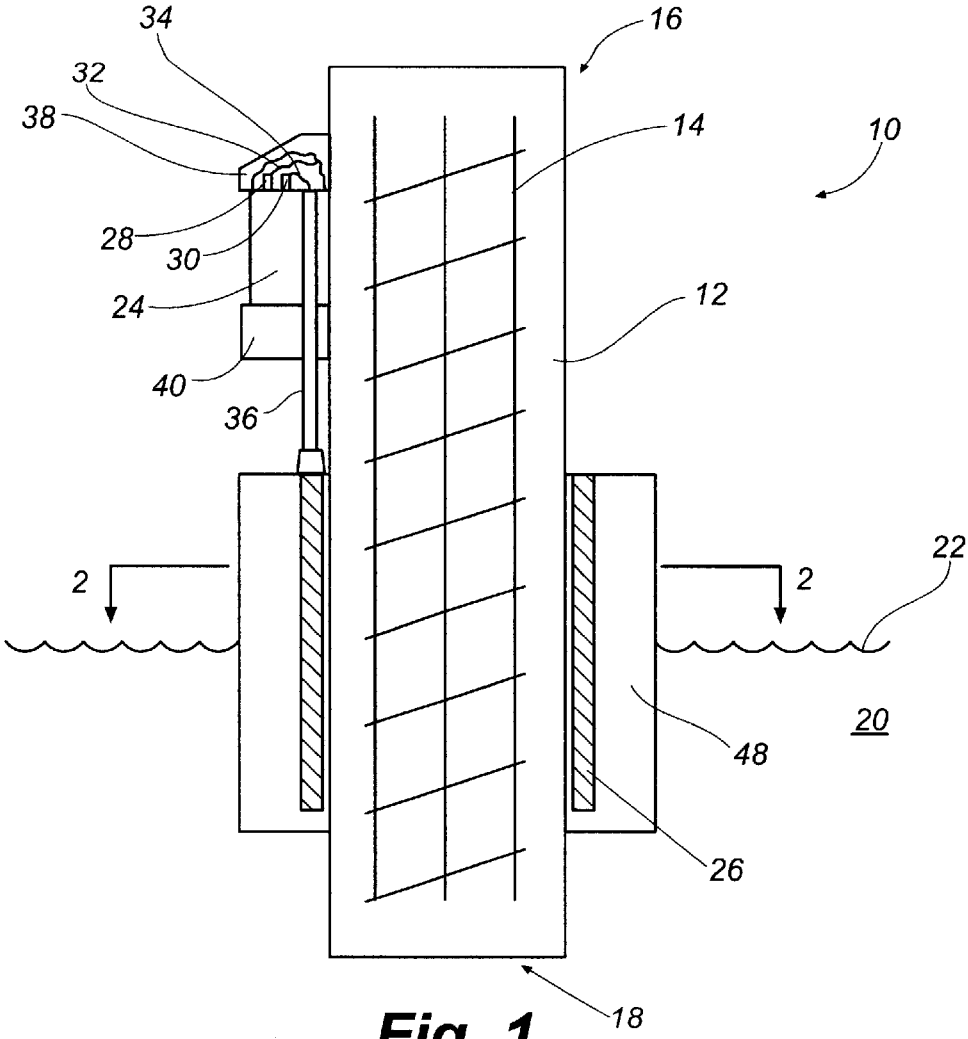
FIG. 1 is a schematic view of a cathodic protection system constructed in accordance with the principles of the present invention.

With reference to the figures in which like numerals designate corresponding parts throughout the several views, FIG. 1 illustrates an embodiment of a cathodic protection system 10 constructed in accordance with the principles of the present invention. More particularly, FIG. 1 illustrates a cathodic protection system 10 as applied to a bridge pile 12.

Although the concepts disclosed herein will be discussed in terms of bridge pilings, it is to be understood that the present system can be used in substantially any application in which cathodic protection for reinforcing steel imbedded in concrete is needed. As is known in the art, the bridge pile 12 comprises a cementitious (e.g., concrete) column that is provided with an internal reinforcing member 14. Typically, this reinforcing member 14 comprises a contiguous lattice work of steel rebar which extends along the length of the pile 12, generally from its top end 16 to its bottom end 18. Although capable of alternative arrangements, the bridge pile 12 shown in FIG. 1 is generally cylindrical in shape, as indicated in cross-section in FIG. 2. Other arrangements for the bridge piling 12 can include, for example, pilings having generally rectangular cross-sections, or cross-sections of substantially any other geometric shape. Returning to FIG. 1, the bridge pile 12 is partially submerged within a body of water 20 having a water line indicated with numeral 22.

The cathodic protection system 10 generally comprises an autonomous (i.e., self-sufficient) battery 24 which, as indicated in FIG. 1, can be mounted to the bridge pile 12 at a position high above the water line 22, and an anode 26 which is configured to surround the bridge pile 12 adjacent the water line 22. The size and weight, as well as the voltage, of the battery 24 will vary depending upon the particular application to which the system 10 is applied. By way of example, the battery 24 can comprise a 1.5 volt, 1,200 ampere-hour battery which is compact, for instance approximately 4 in.×4 in.×9 in. and weighing less than 10 lbs, so that it is well-suited for mounting to the bridge structure in an open-air environment. As described hereinafter, this relatively small size of the battery 24 permits it to be easily handled as well as easily mounted to the bridge pile 12. The battery 24 preferably comprises a metal-air battery such as a zinc-air battery. For reasons discussed below, this battery 24 preferably contains a fully-active, gelled electrolyte solution (not shown). Extending outwardly from the battery 24 is a negative terminal 28 and a positive terminal 30. Formed in the top of the battery 24 are breather holes (not shown) through which air can enter the battery to supply oxygen to the air cathode contained therein. This air cathode is capable of reacting atmospheric oxygen and water to form hydroxyl ions. Along with the zinc-containing anode (i.e., negative battery electrode), the air cathode comprises the positive battery electrode.

Figure 2:
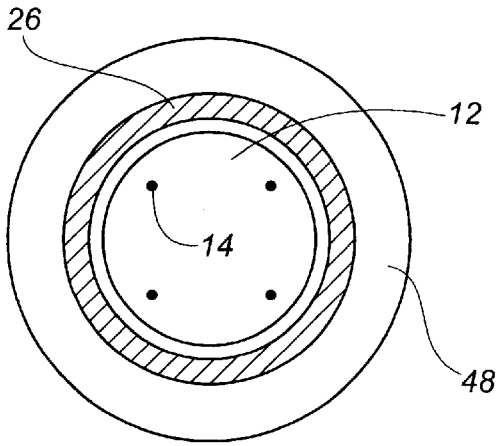
FIG. 2 is a cross-sectional view of an anode used in the system shown in FIG. 1, taken along lines 2—2.

As indicated in FIGS. 1 and 2, the anode 26 can be disposed within a jacket 48. Typically, the jacket 48 is constructed of a semi-porous material such as a cementitious material (e.g., concrete) similar to that used to construct the bridge pile 12 such that water can seep through the jacket 48 and through the bridge pile 12 such that a water "pathway" exists between the anode 26 and the reinforcement member 14. Typically, the anode 26 and its jacket 48 are disposed around the bridge pile 12 adjacent the water line 22 as depicted in FIG. 1. As is known in the art, the region occupied by the anode 26 and its jacket 48 typically extends from about the low water mark to the "splash zone" area above the high water mark. This area tends to be the most destructive area to reinforcing members 14 contained in partially submerged concrete structures due to the availability of both salt water and oxygen. Preferably, the anode 26 comprises a titanium anode that is coated with a catalytic coating which promotes electrochemical activity, however, other suitable materials, including zinc, can be used. As discussed in the foregoing, titanium is preferred in that, unlike zinc, titanium is not a sacrificial material, and therefore will not corrode and will not have to be replaced.

Figure 3:
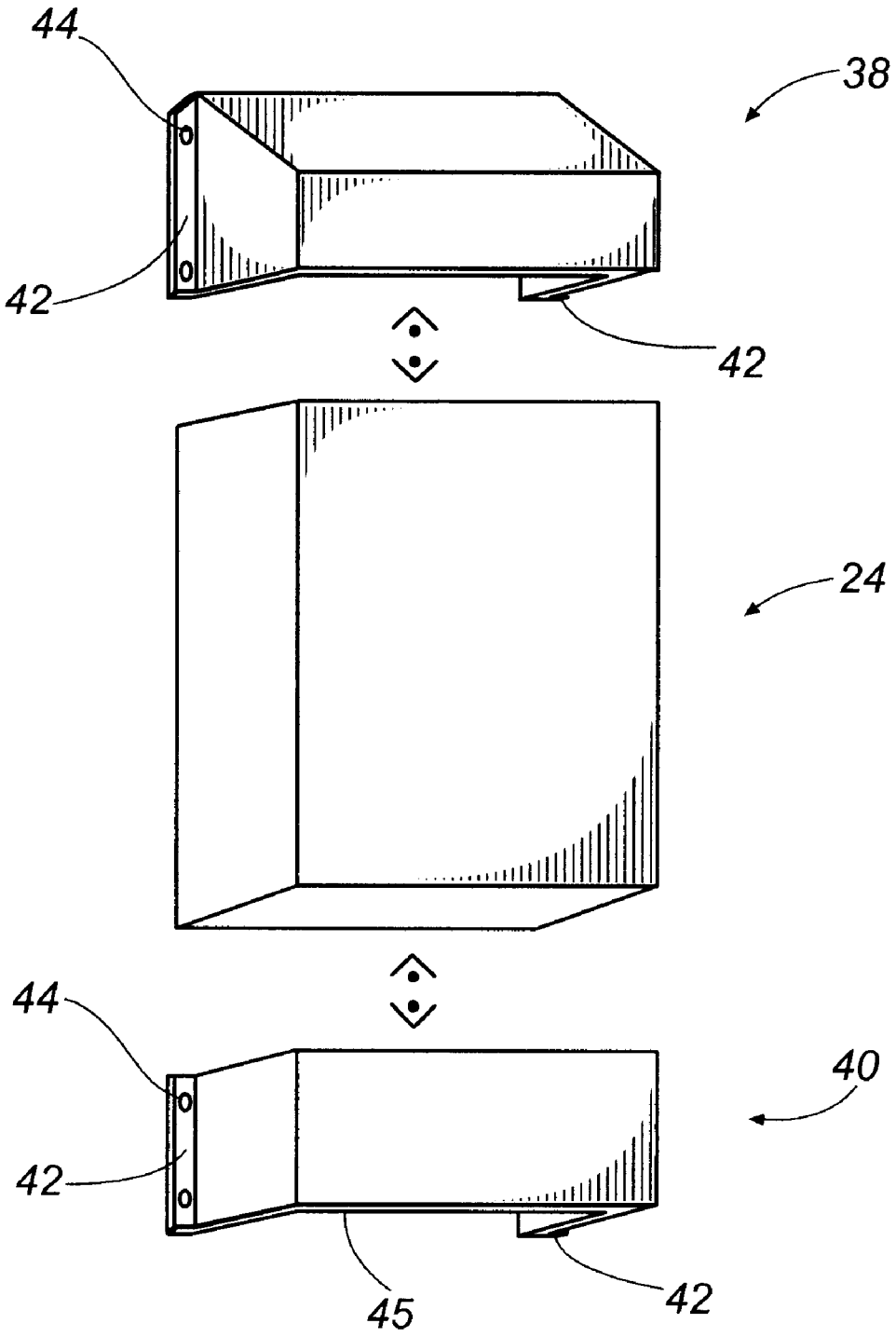
FIG. 3 is a perspective exploded view of a battery and accompanying mounting brackets used in the system shown in FIG. 1.

As is further depicted in FIG. 1, a conductor wire 32 extends from the negative terminal 28 of the battery 24 laterally into the bridge pile 12 to electrically connect to the reinforcing member 14. A similar conductor wire 34 extends from the positive terminal 30 down through a relatively short conduit 36 which leads to the anode 26, such that electrical contact can be made between the positive terminal 30 of the battery 24 and the anode 26. As indicated in FIG. 1, the battery 24 can be mounted to the bridge pile 12 with upper and lower mounting brackets 38 and 40, respectively. This arrangement is shown in greater detail in FIG. 3. In particular, FIG. 3 illustrates, in exploded view, the cooperation of the upper and lower mounting brackets 38 and 40 with the battery 24. As shown in this figure, the upper and lower mounting brackets 38 and 40 can be formed from a thin, rigid, plate-like material such as steel or a rigid plastic. To improve the corrosion resistance of the mounting brackets 38, 40, they can be formed of a corrosion-resistant material such as stainless steel or UV-protected plastics. Alternatively, to reduce costs, painted or galvanized mild steel sheeting can be used. Both brackets 38, 40 are provided with mounting flanges 42 which extend outwardly from the brackets. Each of the mounting flanges 42 is provided with one or more mounting holes 44 through which a fastener of conventional configuration (not shown) can extend to secure the mounting brackets 38, 40 to the structure to which the battery 24 is to be mounted. As indicated in FIG. 3, the upper mounting bracket 38 normally is formed as a hood member which partially enshrouds an upper portion of the battery 24 when it is mounted to the designated structure. This arrangement permits air, and therefore oxygen, to reach the top end of the battery 24 where the breathing holes (not shown) of the battery 24 are located, but prevents rain water from reaching these openings. The lower mounting bracket 40 can be formed as a generally elongated band adapted to wrap around a bottom portion of the battery 24. To support the weight of the battery 24, the lower mounting bracket 40 can be provided with a support flange 45 that extends from the base of the lower mounting bracket 40 in an inward direction.

When the cathodic protection system 10 of the present invention is to be implemented in, for instance, a new bridge construction, each bridge pile 12 is formed with an accompanying jacket 48 and anode 26 disposed thereabout at an axial position that will coincide with the water line 22. Each bridge pile 12 is poured so that a reinforcing member 14 is disposed therein and a conductor wire 34 electrically connected thereto and extending outwardly from the bridge pile 12. At the site, a battery 24 can be mounted to each bridge pile 12 at a position high above the water line 22 such that the batteries 24 will not easily be splashed with water, or be susceptible to "storm surges" which can result in substantial water level increases during tropical storms, hurricanes and the like. As discussed above, a battery 24 can be mounted to each bridge pile 12 with its upper and lower mounting brackets 38 and 40. By way of example, these mounting brackets 38, 40 can be secured to the bridge piles 12 with a minimal number of mounting screws or bolts (not shown). Due to the relatively small size and weight of the battery 24, typically only eight such mounting screws or bolts are needed to secure each battery 24 to each bridge pile 12. Once a battery 24 has been mounted to each bridge pile 12, the batteries 24 can be electrically connected within each protection system 10. In particular, the conductor wire 34 extending from each bridge pile 12 is connected to the negative terminal 28 of its associated battery 24, and the conductor wire 32 is connected to the positive terminal 30 of the battery. The conductor wire 34 is then extended downwardly from the positive terminal 30 of the battery 24 to the associated anode 26. To mechanically protect the conductor wires 34, each conductor wire 34 typically is disposed within a metal or rugged flexible plastic conduit 36 which extends from each battery 24 and anode 26 combination. Once each battery 24 has been electrically connected within the system 10 of each bridge pile 12, cathodic protection is provided to the reinforcement member 14 contained within each bridge pile 12. As is known in the art, an electrical circuit is created between the battery 24, the reinforcing member 14, and the anode 26 such that electrons will flow from the battery 24 to the reinforcing member 14 to scavenge oxygen at the surface of the reinforcing member 14 adjacent the splash zone. Operating in this manner, the iron contained within the reinforcing member 14 will be prevented from oxidizing adjacent the water line. Accordingly, the reinforcing member 14 will not rust within the bridge pilings 12 such that structural integrity of the bridge (or other structure) will be maintained. Moreover, due to the simple design of the cathodic protection system 10, several years of cathodic protection can be provided to the piling reinforcement members 14 with no maintenance whatsoever.

As indicated in FIG. 1, each individual bridge pile 12 is provided with its own cathodic protection system. Due to this arrangement, there is no need to submerge the batteries under water as has been deemed necessary in prior art solutions. Moreover, in that each pile 12 is provided with its own battery 24, the relatively complex and expensive wiring and conduit configurations used in prior art solutions are not necessary. Furthermore, in that each battery 24 comprises a gelled electrolyte, danger of content spillage of each battery 24 during installation and/or content leakage thereafter is avoided. Due to the arrangement of the system 10 described above, the present system 10 is also well-suited for retrofit applications. For instance, if in an existing bridge structure, one or more of the individual bridge piles is in need of cathodic protection, each such pile can be provided with its own a cathodic protection system 10 such as that described in the foregoing. Accordingly, instead of retrofitting the entire structure with a new, elaborate cathodic protection system, discrete piles can be outfitted with the cathodic protection system 10 of the present invention, greatly reducing the labor and costs needed to protect the existing structure.

To provide an idea of the amount of power typically needed to cathodically protect reinforcing steel, particular battery arrangements will be discussed. Bridge pilings typically contain approximately 25 $ft^2$ of steel reinforcing area which requires protection. Experience has shown that once at steady state, an impressed current of approximately 0.5 to 1.5 $mA/ft^2$ is usually sufficient to protect the steel. Initial surge currents on the order of 100 mA or more may be required to polarize new pilings and initiate the cathodic protection process. Assuming a bridge piling with approximately 25 $ft^2$ of steel, and a 100 mA current requirement for 30 days, followed by a steady state current requirement of 1.0 $mA/ft^2$, results in the ampere-hour capacity requirements vs. time provided in Table I.

TABLE I

Ampere-Hour Capacity Requirements vs. Time

| Time - days | Time - years | Current - amps | Amp-Hr. Capacity |
|---|---|---|---|
| 0–30 | 0–0.08 | 0.100 | 72.00 |
| 30–365 | 0.08–1.00 | 0.025 | 201.00 |
| 365–730 | 1.00–2.00 | 0.025 | 219.00 |
| 730–1095 | 2.00–3.00 | 0.025 | 219.00 |
| 1095–1460 | 3.00–4.00 | 0.025 | 219.00 |
| | | Total Req'd. Capacity = | 930.00 |

Allowing for a reasonable utilization factor of 90%, a battery sized to provide a nominal four-year capacity life would be 930 A-hr/0.90=approximately 1,030 amp-hr. Thus, a minimum capacity of 1,000 ampere-hours should be provided. Similarly, a five-year life at 90% utilization would require 1,277 ampere-hours of usable capacity. Thus, based on these typical usage requirements, the preferred metal-air battery will generally incorporate about 1,200 ampere-hours of capacity as a minimum. Assuming a steady state current requirement of 1.5 $mA/ft^2$, a minimum 5-year life would require approximately 1,800 ampere-hours. Thus, metal-air cathodic protection batteries, or battery packs comprised of a plurality of individual batteries (electrically connected in series and/or parallel arrangements), should ideally be sized to individually provide between about 1,200 ampere-hours and 1,800 ampere-hours. It is to be recognized that additional capacity may be packaged within a single battery, or multiple 1,200–1,800 ampere-hour batteries may be electrically connected in parallel to provide additional capacity. For example, if a larger piling or structure requires a steady state current of 50 mA, a five-year life would require approximately 2,200 ampere-hours. Two small 1,200 ampere-hour units connected in parallel to provide a nominal system capacity of 2,400 ampere-hours would satisfy this capacity requirement. Similarly, smaller capacity batteries may be employed and connected in parallel to provide the minimum required capacity.

In addition to a nominal capacity of preferably (but not limited to) approximately 1,200 ampere-hour and approximately 1,800 ampere-hour, the battery 24 used in the system 10 will incorporate a powdered, high surface area zinc anode which is capable of supporting continuous high rate discharge at currents up to 500 mA without significant drop in the battery output voltage. The zinc alloy will be formulated so as to minimize self-discharge loss via zinc corrosion in the alkaline electrolyte. Further, the battery 24 will incorporate a pre-packaged gelled electrolyte to inhibit water loss from the battery and eliminate any need for installation personnel to handle hazardous and corrosive liquid alkaline electrolyte. One such battery is a 1.5 volt, 1,200 ampere-hour battery manufactured by Cegasa and distributed by Celair Corp., designated as part number A S10-2.

Figure 4:
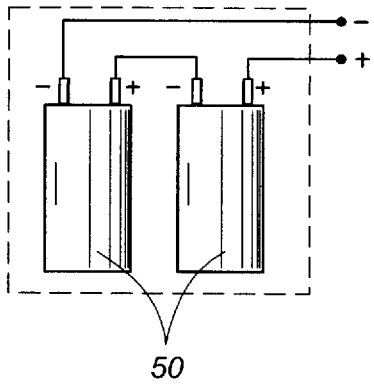
FIG. 4 is a schematic view of a first alternative battery arrangement.
Figure 5:
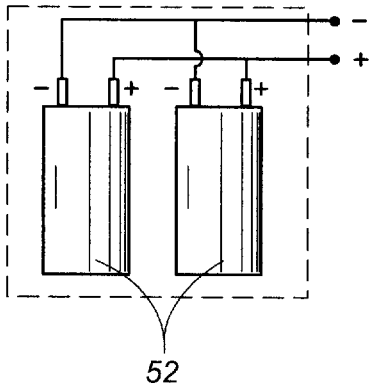
FIG. 5 is a schematic view of a second alternative battery arrangement.
Figure 6:
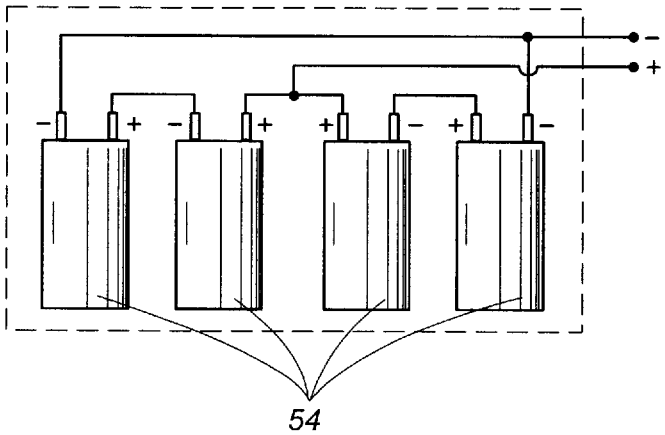
FIG. 6 is a schematic view of a third alternative battery arrangement.

FIGS. 4–6 illustrate alternative power source arrangements that can be used in or with the system 10 described above. The applicability of each of these alternatives depends upon the particular needs of the application to which the system is to be applied. FIG. 4 illustrates two batteries 50 arranged in series. Where each of these batteries 50 comprises a 1.5 volt, 1,200 ampere-hour battery, a 3.0 volt, 1,200 ampere-hour power output is obtained. FIG. 5 illustrates two batteries 52 arranged in parallel. Where each battery 52 comprises a 1.5 volt, 1,200 ampere-hour battery, a 1.5 volt, 2,400 amp-hour power source is provided. FIG.

6 illustrates four batteries 54 arranged such that two of the batteries 54 are arranged in series and two of the batteries 54 are arranged in parallel. In this arrangement, a 3.0 volt, 2,400 ampere-hour capacity system is provided.

Figure 7:
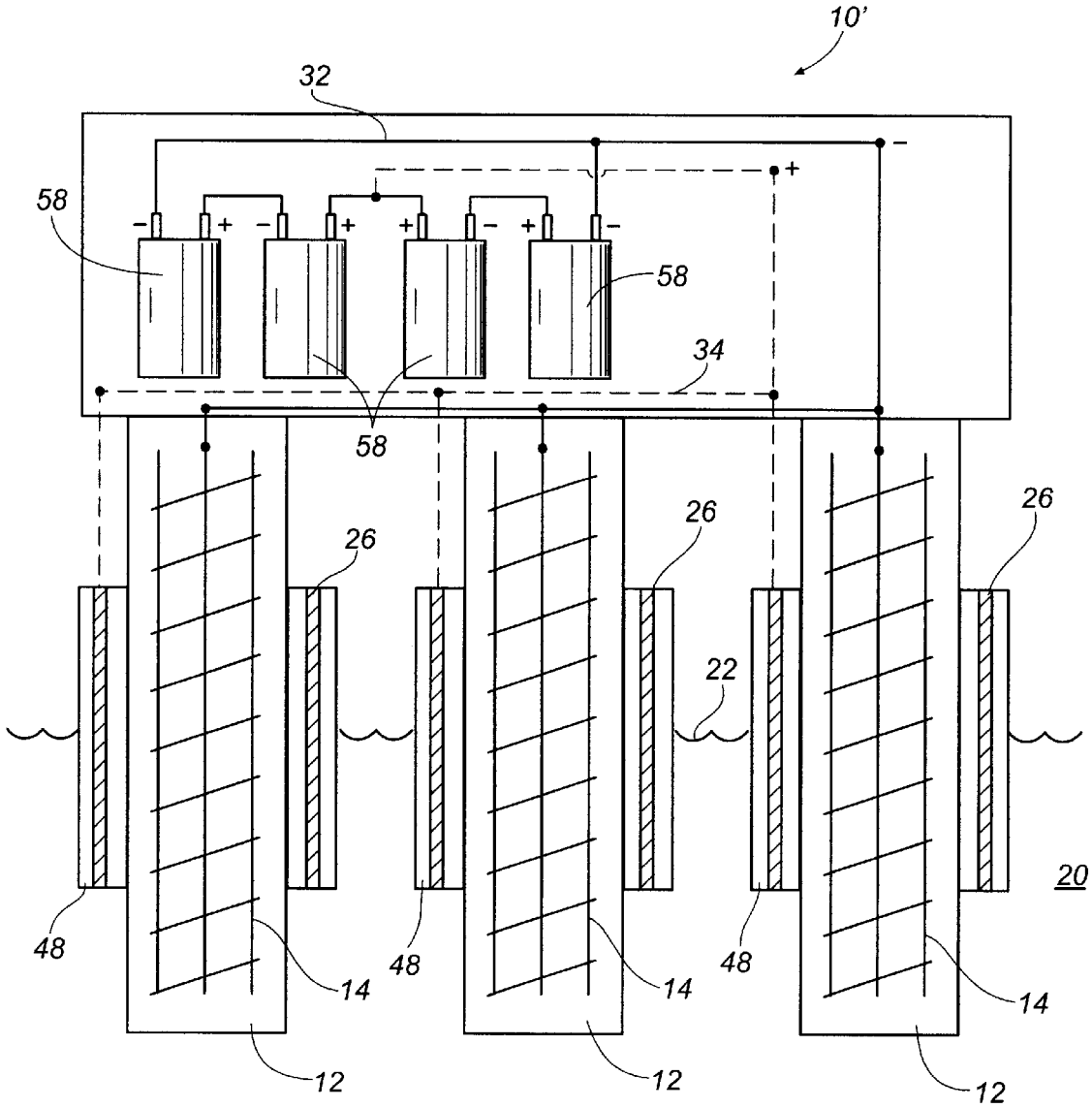
FIG. 7 is a schematic view of an alternative cathodic protection system constructed in accordance with the present invention.

FIG. 7 illustrates an alternative arrangement of a cathodic protection system 10' constructed in accordance with the principles of the present invention. In particular, FIG. 7 illustrates a system 10' which is well-suited for retrofit applications. In such an application, an existing AC/DC system or solar energy based system can be replaced with a plurality of batteries 58 arranged in series and/or parallel. Accordingly, the structure may include existing anode composed of zinc (e.g., from a previous galvanic protection system) that can be utilized with a system according to the present invention. In that the existing structure has already been provided with a cathodic protection system in such retrofit applications, the arrangement shown in FIG. 7 can utilize the existing wiring and conduit system of the structure. Accordingly, each battery 58 can be mounted to the structure at an appropriate location, for example, with the mounting brackets 38, 40, and electrically connected to the various reinforcing members 14 and anodes 26 of each bridge pile 12. The effective negative terminal of the power source comprising the multiple batteries 58 can be electrically connected to each of the reinforcing members 14 and the effective positive terminal of the power source can be electrically connected to each anode 26. Arranged in this manner, adequate power will be provided in a cathodic protection circuit encompassing the entire structure (or a large portion thereof) to ensure that the reinforcing members 14 are prevented from rusting. Assuming each battery 58 as being a 1.5 volt, 1,200 ampere-hour battery, the four parallel/two series arrangement shown in FIG. 7 will provide 3.0 volts at 4,800 ampere-hours. Once the system 10' is implemented, all unnecessary existing componentry and hardware, such as DC rectifiers and/or solar cells, can be removed.

While particular embodiments of the invention have been disclosed in detail in the foregoing description and drawings for purposes of example, it will be understood by those skilled in the art that variations and modifications thereof can be made without departing from the spirit and scope of the invention as set forth in the following claims.

What is claimed is:

1. A cathodic protection system for inhibiting oxidation of a reinforcing member disposed within a cementitious structure, comprising:

a compact, autonomous battery adapted to mount to the cementitious structure at an open-air location, said battery having a positive terminal and a negative terminal;

a conductor adapted to electrically connect said negative terminal of said battery to the reinforcing member of the cementitious structure;

an anode jacket constructed of a cementitious material and being adapted to be placed in physical contact with the cementitious structure; and an anode disposed within said anode jacket and being adapted to be positioned proximate to a portion of the reinforcing member disposed within the cementitious structure that is to be cathodically protected, said anode being electrically connected to said positive terminal of said battery.

2. The system of claim 1, wherein said battery comprises a metal-air battery.

3. The system of claim 1, wherein said battery comprises a zinc-air battery.

4. The system of claim 1, wherein said battery contains a gelled electrolyte solution.

5. The system of claim 1, wherein said battery weighs less than approximately 10 pounds.

6. The system of claim 1, wherein said battery is an approximately 1.5 volt battery.

7. The system of claim 1, wherein said battery has an approximately 1,200 ampere-hour capacity.

8. The system of claim 1, wherein said anode is constructed of titanium.

9. The system of claim 8, wherein said titanium anode is coated with a catalytic coating.

10. A cathodic protection system for inhibiting oxidation of a reinforcing member disposed within a concrete bridge pile, comprising:

a compact, autonomous battery adapted to mount to the pile at a position well above the water line, said battery having a positive terminal and a negative terminal;

a conductor adapted to electrically connect said negative terminal of said battery to the reinforcing member of the bridge pile;

an anode jacket constructed of a cementitious material and being adapted to surround and make physical contact with the bridge pile at an axial position along the pile adjacent the water line; and an anode disposed within said anode jacket at a position proximate to the reinforcing member and being electrically connected to said positive terminal of said battery;

wherein said battery is used to provide power only to the bridge pile to which it mounts.

11. The system of claim 10, wherein said battery comprises a metal-air battery.

12. The system of claim 10, wherein said battery comprises a zinc-air battery.

13. The system of claim 10, wherein said battery contains a gelled electrolyte solution.

14. The system of claim 10, wherein said battery weighs less than approximately 10 pounds.

15. The system of claim 10, wherein said battery is an approximately 1.5 volt battery.

16. The system of claim 10, wherein said battery has an approximately 1,200 ampere-hour capacity.

17. The system of claim 10, wherein said anode is constructed of titanium.

18. The system of claim 17, wherein said titanium anode is coated with a catalytic coating.

19. The system of claim 10, wherein said battery mounts to the bridge pile with one or more mounting brackets.

20. The system of claim 10, further comprising a mounting bracket that at least partially enshrouds a top portion of said battery.

21. The system of claim 20, wherein said mounting bracket comprises a top bracket and a bottom bracket, said bottom bracket supporting the weight of said battery.

22. A cathodic protection system for inhibiting oxidation of reinforcing members disposed within a plurality of concrete bridge piles, comprising:

a power source comprising at least one compact battery adapted to mount to the bridge at a position well above the water line, each battery having a positive terminal and a negative terminal;

a wiring arrangement adapted to electrically connect said power source to a pre-existing wiring arrangement of the bridge which makes electrical contact with a plurality of the reinforcing members of the bridge piles, said wiring arrangement being electrically connected to an effective negative terminal of said power source so as to be adapted to connect said effective negative terminal of said power source to the plurality of the reinforcing members of the bridge piles;

a plurality of anode jackets constructed of a cementitious material, each anode jacket being adapted to surround and make physical contact with one of the bridge piles at an axial position along the pile adjacent the water line; and a plurality of anodes, one anode disposed within each anode jacket and being electrically connected to an effective positive terminal of said power source with said wiring arrangement;

wherein said power source simultaneously provides power to each of the bridge piles provided with an anode.

23. The system of claim 22, wherein at least one of said batteries comprises a metal-air battery.

24. The system of claim 22, wherein at least one of said batteries comprises a zinc-air battery.

25. The system of claim 22, wherein at least one of said batteries contains a gelled electrolyte solution.

26. The system of claim 22, wherein at least one of said batteries weighs less than approximately 10 pounds.

27. The system of claim 22, wherein at least one of said batteries is an approximately 1.5 volt battery.

28. The system of claim 22, wherein at least one of said batteries has an approximately 1,200 ampere-hour capacity.

29. The system of claim 22, wherein said anodes are constructed of titanium.

30. The system of claim 29, wherein said titanium anodes are coated with a catalytic coating.

31. The system of claim 22, further comprising at least one mounting bracket that at least partially enshrouds a top portion at least one of said batteries.

32. The system of claim 31, wherein said at least one mounting bracket comprises a top bracket and a bottom bracket, said bottom bracket supporting the weight of at least one of said batteries.

33. A building structure having a plurality of concrete piles, each of the piles having an internal reinforcing member, comprising:

a compact, autonomous battery mounted to substantially each of the piles at an axial position along the pile well above the water line, each battery having a positive terminal and a negative terminal;

a first conductor electrically connecting said negative terminal of each battery to the reinforcing member disposed within its respective pile;

an anode jacket constructed of a cementitious material that contiguously surrounds the pile at an axial position along the pile which coincides with the water line;

an anode disposed within said anode jacket; and a second conductor electrically connecting said positive terminal of each battery to the anode of its respective pile;

wherein each battery separately provides power to only to its respective pile.

34. The structure of claim 33, wherein at least one of said batteries comprises a metal-air battery.

35. The structure of claim 33, wherein at least one of said batteries comprises a zinc-air battery.

36. The structure of claim 33, wherein at least one of said batteries contains a gelled electrolyte solution.

37. The structure of claim 33, wherein at least one of said batteries weighs less than approximately 10 pounds.

38. The structure of claim 33, wherein at least one of said batteries is an approximately 1.5 volt battery.

39. The structure of claim 33, wherein at least one of said batteries has an approximately 1,200 ampere-hour capacity.

40. The structure of claim 33, wherein said anodes are constructed of titanium.

41. The structure of claim 40, wherein said titanium anodes are coated with a catalytic coating.

42. The structure of claim 33, wherein said batteries mount to said bridge piles with one or more mounting brackets.

43. A method for cathodically protecting a reinforcing member disposed within a concrete structure, comprising the steps of:

positioning an anode adjacent the reinforcing member to be protected within a cementitious material contiguous with the concrete structure in which the reinforcing member is disposed;

electrically connecting the anode to a compact, autonomous battery that can be mounted to the concrete structure in an open-air environment; and electrically connecting the battery only to the reinforcing member of the concrete structure.

44. The method of claim 43, wherein the battery comprises a metal-air battery.

45. The method of claim 43, wherein the battery contains a gelled electrolyte solution.

46. The method of claim 43, wherein the battery weighs less than approximately 10 pounds.

47. The method of claim 43, wherein the battery is an approximately 1.5 volt battery.

48. The method of claim 43, wherein the battery has an approximately 1,200 ampere-hour capacity.

49. The method of claim 43, wherein the anode is constructed of titanium.

50. The method of claim 49, wherein the titanium anode is coated with a catalytic coating.

51. The method of claim 43, wherein the battery mounts to the structure with a mounting bracket.

52. The method of claim 51, wherein the mounting bracket at least partially enshrouds a top portion of the battery.

53. The method of claim 51, wherein the mounting bracket comprises a top bracket and a bottom bracket, the bottom bracket supporting the weight of the battery.

54. A method for cathodically protecting reinforcing members disposed within bridge pilings, comprising the steps of:

forming a jacket around each of the bridge pilings at an anticipated water line, the jacket being contiguous with the bridge pile to which it is attached;

disposing an anode within each jacket, each anode substantially surrounding each bridge pile adjacent the water line;

mounting a compact, autonomous battery to each bridge pile at a point well above the water line;

electrically connecting each battery to the respective anode disposed about its bridge pile; and electrically connecting each battery to the respective reinforcing member of its bridge pile; wherein each bridge pile is provided with its own autonomous cathodic protection.

55. The method of claim 54, wherein each battery comprises a metal-air battery.

56. The method of claim 54, wherein each battery contains a gelled electrolyte solution.

57. The method of claim 54, wherein each battery weighs less than approximately 10 pounds.

58. The method of claim 54, wherein each battery is an approximately 1.5 volt battery.

59. The method of claim 54, wherein each battery has an approximately 1,200 ampere-hour capacity.

60. The method of claim 54, wherein the anodes are constructed of titanium.

61. The method of claim 60, wherein the titanium anodes are coated with a catalytic coating.

62. The method of claim 54, wherein each battery mounts to the bridge pilings with a mounting bracket.

63. The method of claim 62, wherein the mounting brackets at least partially enshroud a top portion of each battery.

64. The method of claim 62, wherein the mounting brackets each comprise a top bracket and a bottom bracket, the bottom bracket supporting the weight of its associated battery.

65. A cathodic protection system for inhibiting oxidation of a reinforcing member disposed within a cementitious structure, comprising:

an autonomous battery adapted to mount to the cementitious structure at an open-air location, said battery having a positive terminal and a negative terminal;

a conductor adapted to electrically connect said negative terminal of said battery to the reinforcing member of the cementitious structure;

an anode jacket constructed of a cementitious material and being adapted to be placed in physical contact with the cementitious structure; and an anode disposed within said anode jacket and being adapted to be positioned proximate to a portion of the reinforcing member disposed within the cementitious structure that is to be cathodically protected, said anode being electrically connected to said positive terminal of said battery.

66. The system of claim 65, wherein said battery comprises a metal-air battery.

67. The system of claim 65, wherein said battery comprises a zinc-air battery.

68. The system of claim 65, wherein said battery contains a gelled electrolyte solution.

69. The system of claim 65, wherein said battery weighs less than approximately 10 pounds.

70. The system of claim 65, wherein said battery is an approximately 1.5 volt battery.

71. The system of claim 65, wherein said battery has an approximately 1,200 ampere-hour capacity.

72. The system of claim 65, wherein said anode is constructed of titanium.

73. The system of claim 72, wherein said titanium anode is coated with a catalytic coating.

* * * * *